US005558229A

United States Patent [19]

Halbich

[11] Patent Number: 5,558,229

[45] Date of Patent: Sep. 24, 1996

[54] DISPENSER ASSEMBLY AND METHOD OF ADMINISTERING MEDICATION

[76] Inventor: Frank Halbich, 4960 Frazier Dr., Post Falls, Id. 83854

[21] Appl. No.: 406,398

[22] Filed: Mar. 20, 1995

[51] Int. Cl.[6] ..... B65D 83/04

[52] U.S. Cl. ..... 206/534; 206/538; 206/540; 206/558; 206/499

[58] Field of Search ..... 206/534, 538, 206/533, 540, 558, 561, 45.11, 45, 499, 558, 565; 312/310, 308, 270.3, 267, 42; 220/23.83, 23.4

[56] References Cited

U.S. PATENT DOCUMENTS

| | | | |
|---|---|---|---|
| 256,640 | 4/1882 | Clark | 206/561 X |
| 2,851,188 | 9/1958 | Pavelle | 206/558 |
| 3,308,962 | 3/1967 | Bryant . | |
| 3,497,982 | 3/1970 | Schulz | 206/534 X |
| 3,592,337 | 7/1971 | Phillips, Jr. | 206/461 X |
| 3,638,603 | 2/1972 | Conover | 206/538 X |
| 3,703,955 | 11/1972 | Inacker | 206/538 X |
| 4,038,937 | 8/1977 | Möe | 206/538 X |
| 4,071,065 | 1/1978 | Halbich . | |
| 4,084,695 | 4/1978 | Halbich . | |
| 4,163,496 | 8/1979 | Dogliotti . | |
| 4,164,309 | 8/1979 | Staats . | |
| 4,253,572 | 3/1981 | Halbich . | |
| 4,318,477 | 3/1982 | Kerpe | 206/534 |
| 4,372,445 | 2/1983 | Keffeler . | |
| 4,403,462 | 9/1983 | Halbich . | |
| 4,473,156 | 9/1984 | Martin . | |
| 4,735,318 | 4/1988 | Keffeler . | |
| 4,741,441 | 5/1988 | Keffeler . | |
| 4,749,085 | 6/1988 | Denney | 206/534 |
| 4,793,492 | 12/1988 | Halbich . | |
| 5,011,018 | 4/1991 | Keffeler . | |
| 5,159,581 | 10/1992 | Agans | 206/538 X |
| 5,251,757 | 10/1993 | Relyea et al. | 206/531 |
| 5,267,650 | 12/1993 | Gilbilisco . | |
| 5,358,692 | 10/1994 | Reynolds | 206/558 X |

*Primary Examiner*—Paul T. Sewell
*Assistant Examiner*—Tara L. Laster
*Attorney, Agent, or Firm*—Wells, St. John, Roberts, Gregory & Matkin, P.S.

[57] ABSTRACT

An assembly comprising a plurality of dispensers, each dispenser having a plurality of compartments, and a tray selectively receiving the plurality of dispensers in a row, the tray having a length and opposite ends along the length, the dispensers being arranged along the length of the tray, the dispensers and the tray having interengaging opposed surfaces which both in combination permit sliding of the dispensers within the tray and along the length of the tray, and which restrain transverse removal of the dispensers from the tray except for at least one dispenser located at one of the ends of the tray, so that a user can discern based on the restraint whether the user is attempting to remove the one endmost dispenser or another dispenser from the tray.

6 Claims, 9 Drawing Sheets

DISPENSER ASSEMBLY AND METHOD OF ADMINISTERING MEDICATION

TECHNICAL FIELD

The invention relates generally to compartmentalized dispensers such as for use in dispensing pills or capsules. More particularly, the invention relates to an assembly of compartmentalized dispensers.

BACKGROUND OF THE INVENTION

In treating a patient, it is common to prescribe one or more medications. The medications are usually available in capsule or tablet form. The patient is then required to take medications at various intervals during a day. The patient often has many doses of medication to take during the day, and it can sometimes be confusing what medication to take at what time. This confusion is compounded in that medication must often be taken during the course of a week or several weeks. It is sometimes necessary to maintain a correct concentration of a medication in the patient by adding a full or half dose every second or third day. This adds to confusion in dispensing of the medication. It is desirable to provide a means for a health care provider to the patient to be able to quickly determine if the patient has taken all medications for a given day. It may also be desirable to provide a means for a health care provider to predetermine and prearrange the necessary medications for the patient for an extended period of time, such as a week.

Compartmentalized dispensers for dispensing pills or capsules are known in the art. Each dispenser has several compartments which each contain a unit dose of medication. At various intervals during the day, the patient or medical personnel opens one of the compartments and the patient ingests the medication contained in that compartment. The following references disclose compartmentalized dispensers, and are incorporated herein by reference: U.S. Pat. No. 5,267,650 to Gilbilisco; U.S. Pat. No. 5,011,018 to Keffeler; U.S. Pat. No. 4,793,492 to Halbich; U.S. Pat. No. 4,749,085 to Denney; U.S. Pat. No. 4,741,441 to Keffeler; U.S. Pat. No. 4,735,318 to Keffeler; U.S. Pat. No. 4,473,156 to Martin; U.S. Pat. No. 4,403,462 to Halbich; U.S. Pat. No. 4,372,445 to Keffeler; U.S. Pat. No. 4,253,572 to Halbich; U.S. Pat. No. 4,164,309 to Staats; U.S. Pat. No. 4,163,496 to Dogliotti; U.S. Pat. No. 4,084,695 to Halbich; 4,071,065 to Halbich; and U.S. Pat. No. 3,308,962 to Bryant.

SUMMARY OF THE INVENTION

The invention provides a medication dispenser assembly comprising a plurality of medication dispensers, the dispensers respectively having a plurality of unit dosage compartments. The dispensers respectively have a top side through which the compartments can be accessed, and the dispensers respectively have a bottom side opposite the top side. The assembly further includes a tray having an open top. The tray has a length, and selectively receives the plurality of dispensers in a row with the tops and bottoms of the dispensers arranged perpendicularly relative to the length of the tray. The dispensers extend beyond the open top and are accessible through the open top. The dispensers are slidable along the length of the tray, and the dispensers are color coded, with different color dispensers representing different days of the week.

BRIEF DESCRIPTION OF THE DRAWINGS

Preferred embodiments of the invention are described below with reference to the following accompanying drawings.

FIG. 4 is a top view of a dispenser included in the medication dispenser assembly of FIG. 1.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
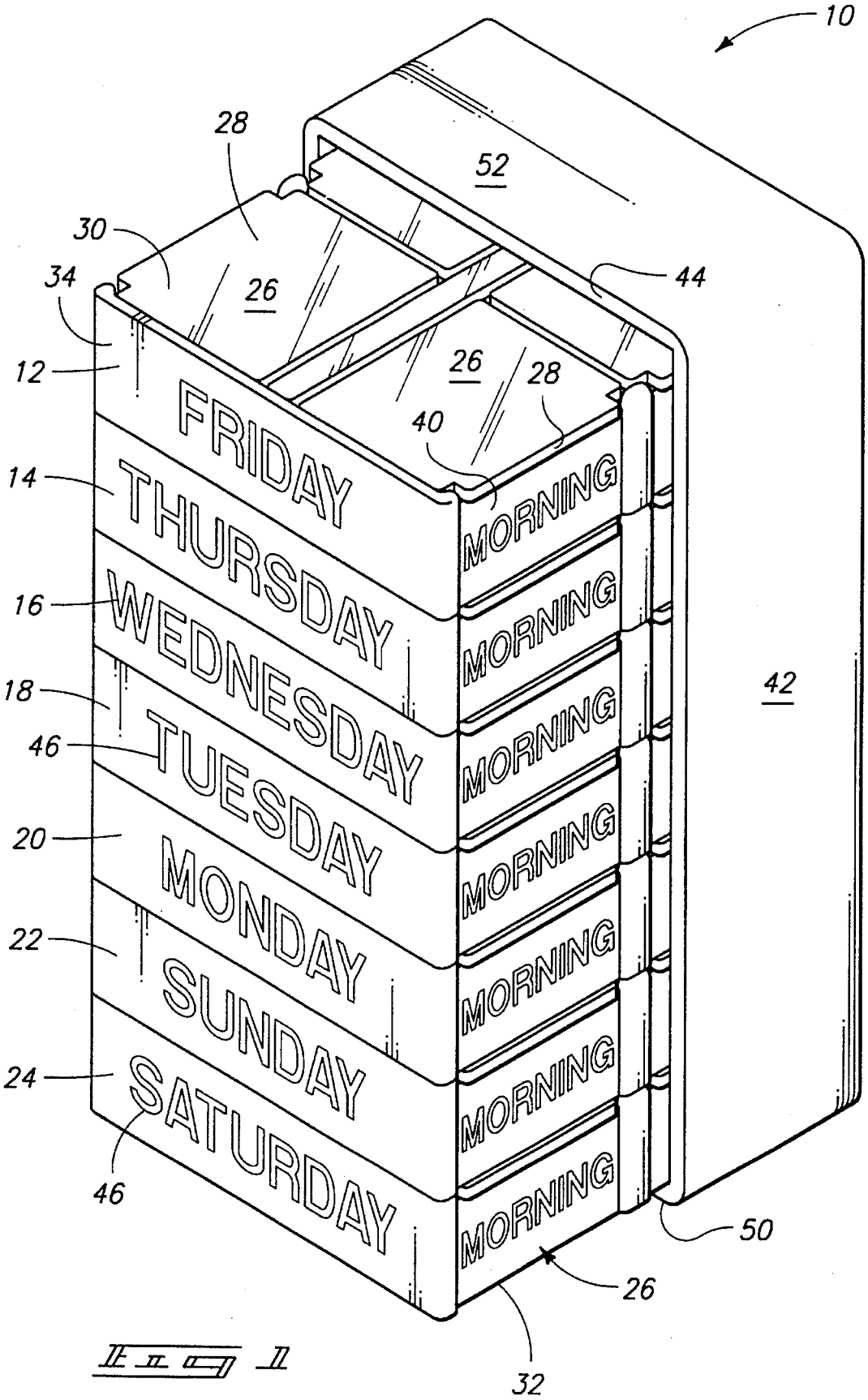
FIG. 1 is a perspective view showing a medication dispenser assembly sitting on its end.

Shown in FIG. 1 is a medication dispenser assembly 10. The dispenser assembly 10 includes a plurality of medication dispensers 12, 14, 16, 18, 20, 22, and 24. Each dispenser has a plurality of compartments 26, which can be filled with medicine or other pills or capsules to be consumed at a particular interval or time during a day. Each dispenser also has a plurality of lids 28, associated with the compartments 26, which are used to open and close the compartments.

Figure 5:
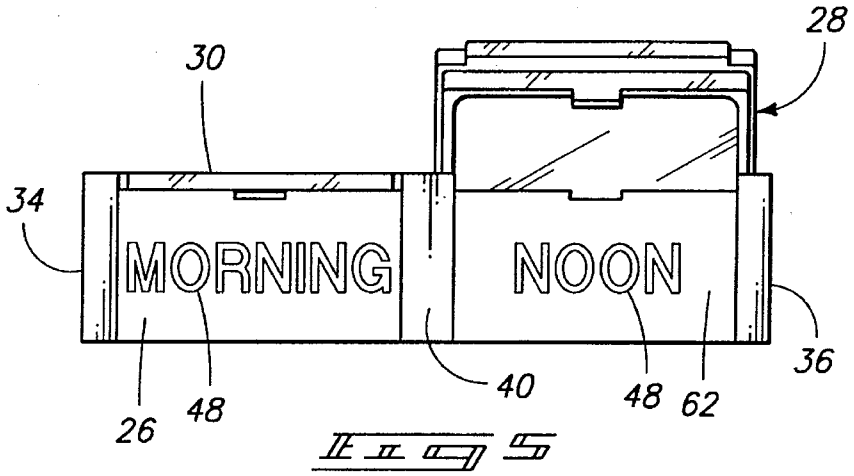
FIGS. 5 and 6 are side views of the dispenser of FIG. 4.
Figure 6:
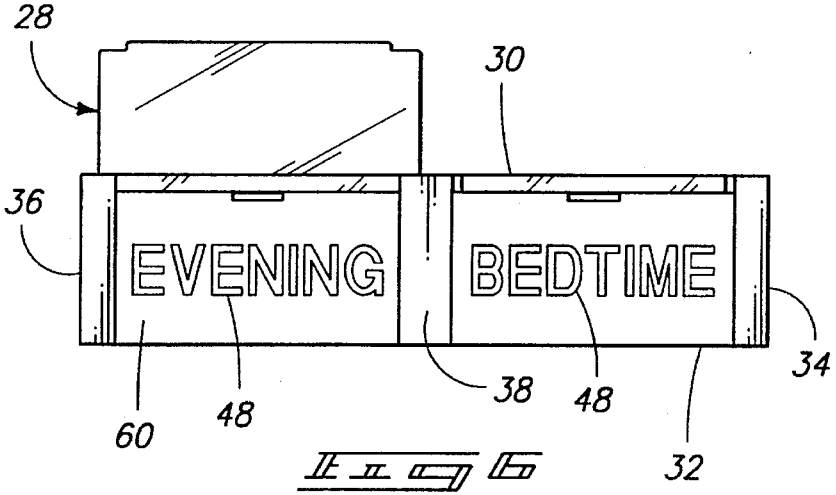

Each dispenser has a top side 30 through which the compartments 26 can be accessed (FIG. 6). Each dispenser has a bottom side 32 opposite the top side 30. Each dispenser also has edges 34, 36, 38, and 40 between the top side 30 and bottom side 32 of the dispenser (FIGS. 4–6). Each dispenser is designed to contain medication for one day of a week.

Figure 9:
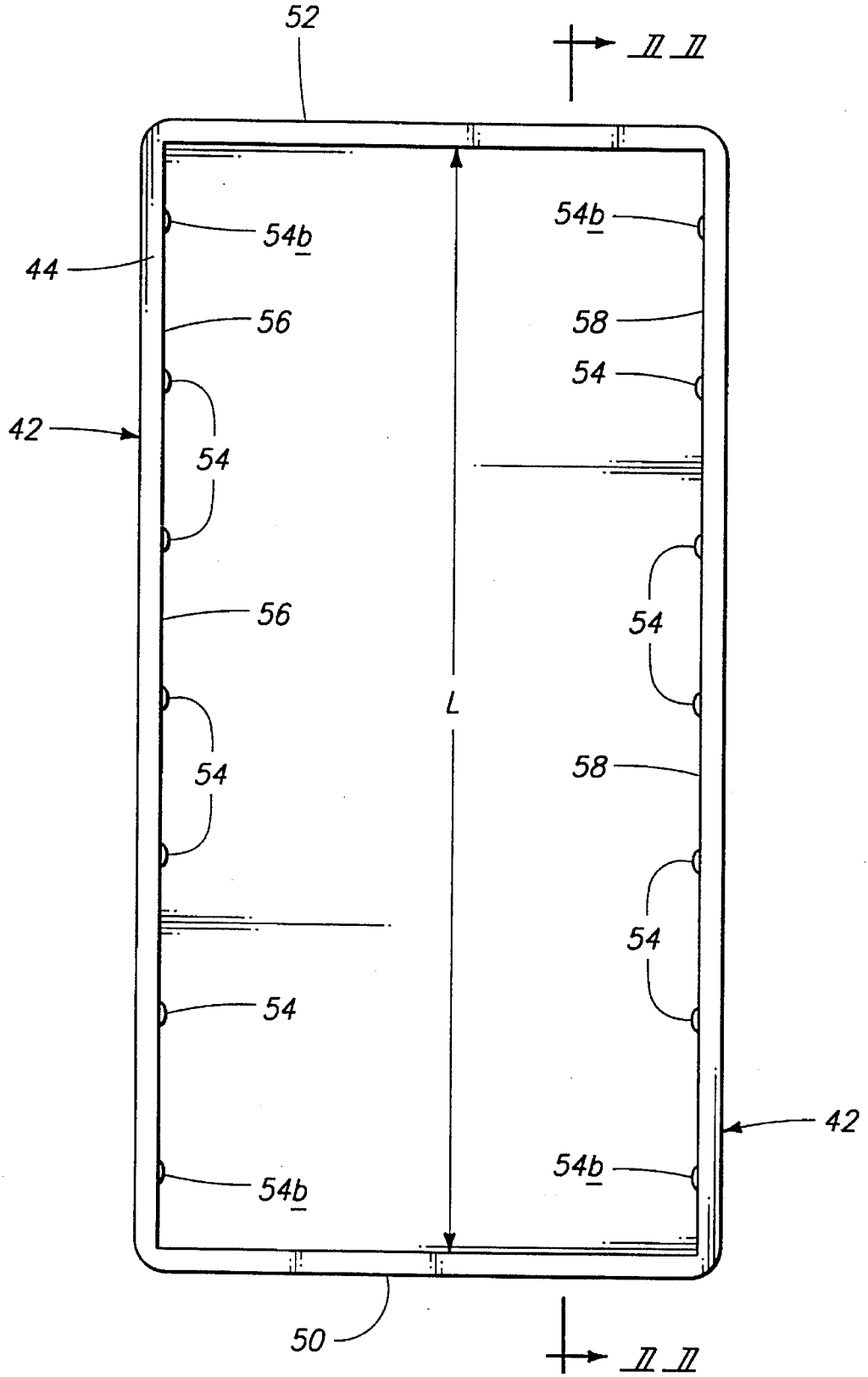
FIG. 9 is a top view of a tray included in the medication dispenser assembly of FIG. 1.
Figure 13:
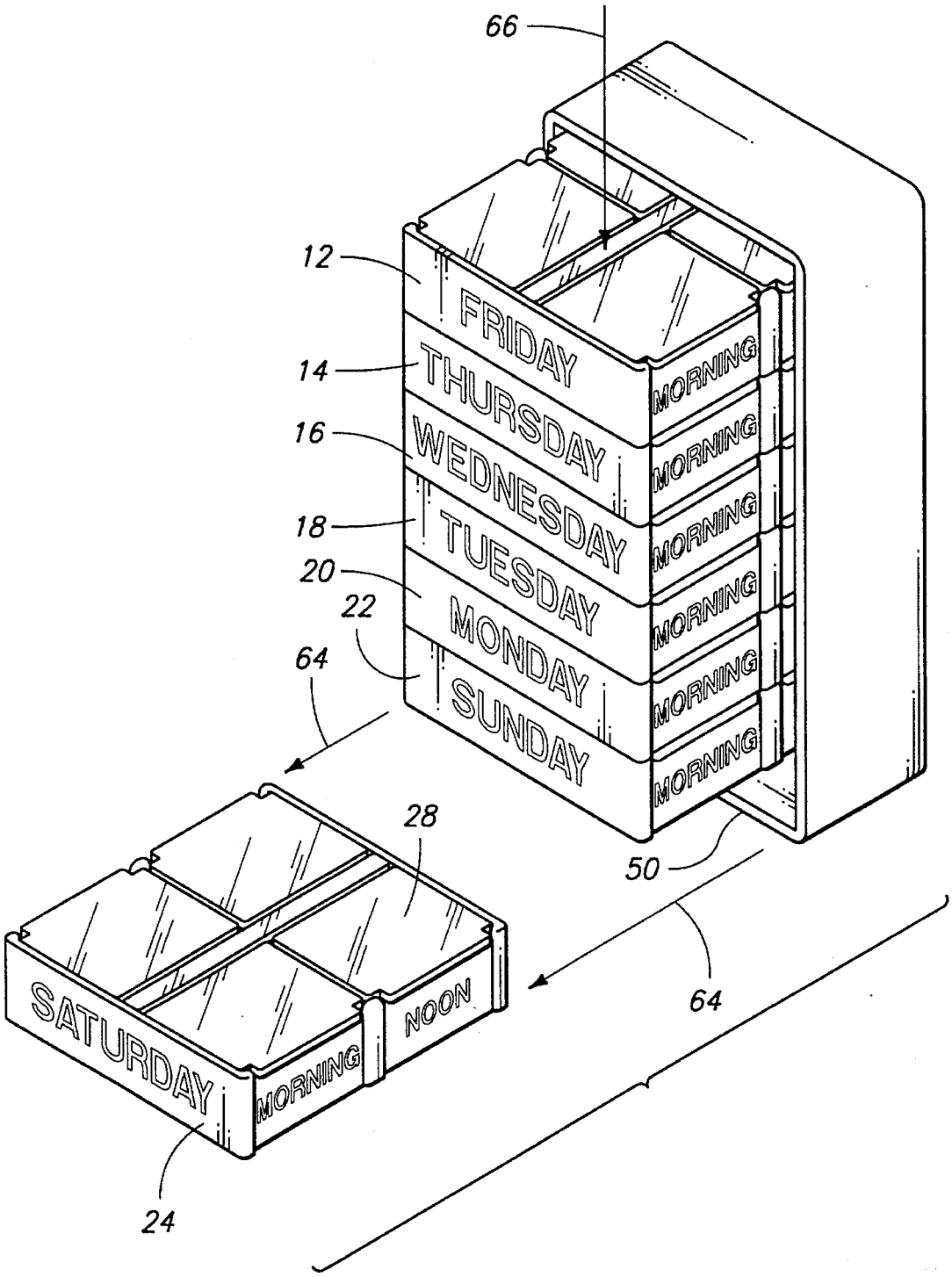
FIGS. 13 and 14 illustrate a method of using the dispenser assembly of FIG. 1.

The medication dispenser assembly 10 also includes a tray 42 (FIG. 9). The tray 42 has a length L, and has an open top 44. The tray 42 selectively receives the plurality of dispensers 12, 14, 16, 18, 20, 22, and 24 in a row with the tops 30 and bottoms 32 of the dispensers arranged perpendicularly to the length of the tray 42. The dispensers extend beyond the open top 44 of the tray 42 and are accessible by a user through the open top 44 of the tray 42. The dispensers are slidable along the length of the tray 42 for a reason that will later be described (FIG. 13).

Figure 2:
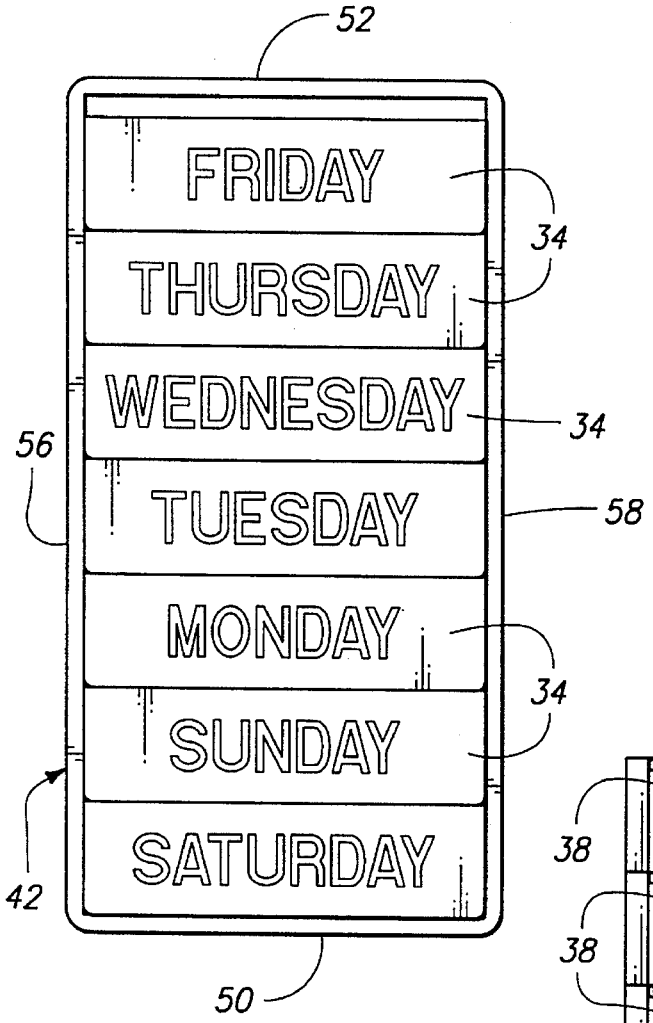
FIG. 2 is a top view of the medication dispenser assembly of FIG. 1.
Figure 3:
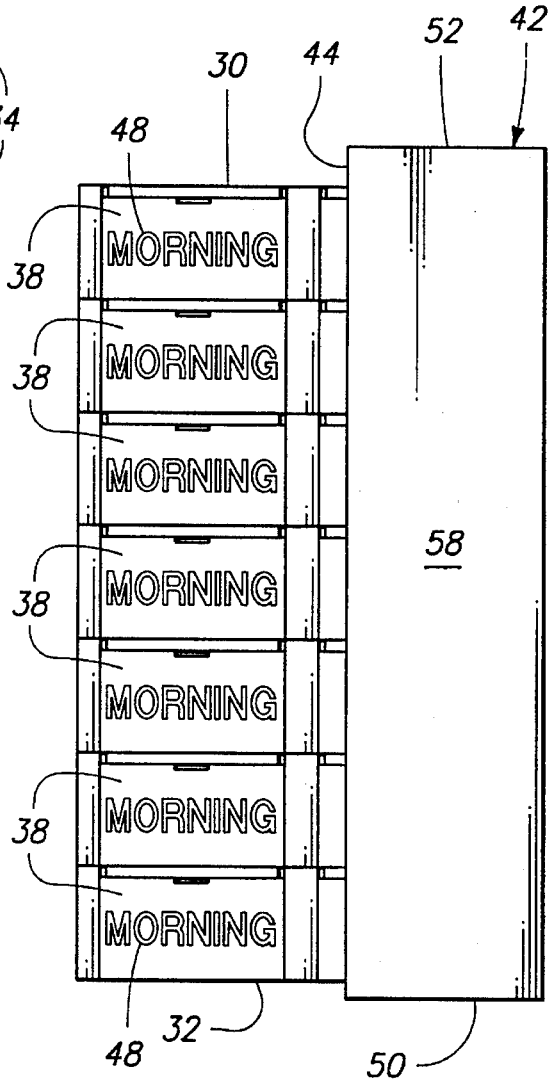
FIG. 3 is a side view of the medication dispenser assembly of FIG. 1.

The dispensers are color coded, with different color dispensers representing different days of the week. For example, in one embodiment of the invention, the dispenser 12 is blue, the dispenser 14 is red, the dispenser 16 is green, the dispenser 18 is light blue, the dispenser 20 is light green, the dispenser 22 is white, and the dispenser 24 is yellow. Other color coding arrangements are possible. Further, the dispensers respectively include indicia 46, in addition to color, indicating the day of the week during which the respective dispensers are to be used. More particularly, each dispenser has a unique day of the week displayed on its edge 34 indicating the day of the week during which the particular dispenser is to be used (FIGS. 1 and 2). For example, in one embodiment of the invention, the edge 34 of dispenser 12 displays the word "FRIDAY", the edge 34 of the dispenser 14 displays the word "THURSDAY", the edge 34 of the dispenser 16 displays the word "WEDNESDAY", the edge 34 of the dispenser 18 displays the word "TUESDAY", the edge 34 of the dispenser 20 displays the word "MONDAY", the edge 34 of the dispenser 22 displays the word "SUNDAY", and the edge 34 of the dispenser 24 displays the word "SATURDAY".

Figure 14:
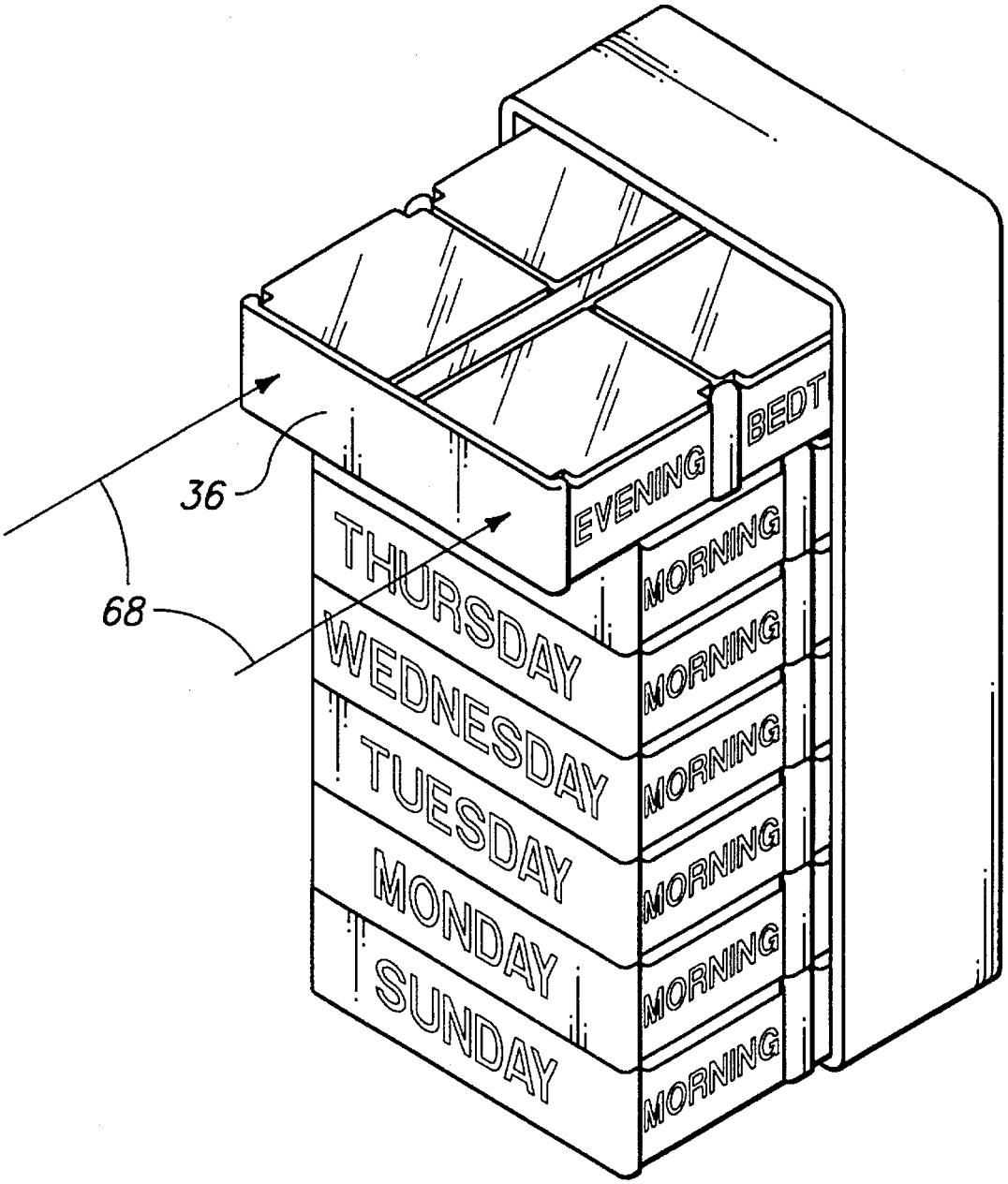

The tray 42 houses each dispenser in an orientation wherein the day of the week is visible (FIGS. 1 and 2), or in an orientation wherein the day of the week is not visible (FIG. 14). More particularly, in the illustrated embodiment, the edge 36 of each dispenser opposite the edge 34 displaying the day of the week is preferably blank or otherwise lacking day of the week information, and the dispenser is symmetrical such that it can be removed from the tray, rotated 180° about the length axis, and reinserted into the tray 42. Each dispenser further includes indicia 48 on edges 38 and 40, which indicate the time of day when a capsule in an adjacent compartment is to be taken. Such time of day indicia 48 is provided for each compartment and comprises words such as "MORNING", "NOON", "EVENING", and "BEDTIME".

Figure 7:
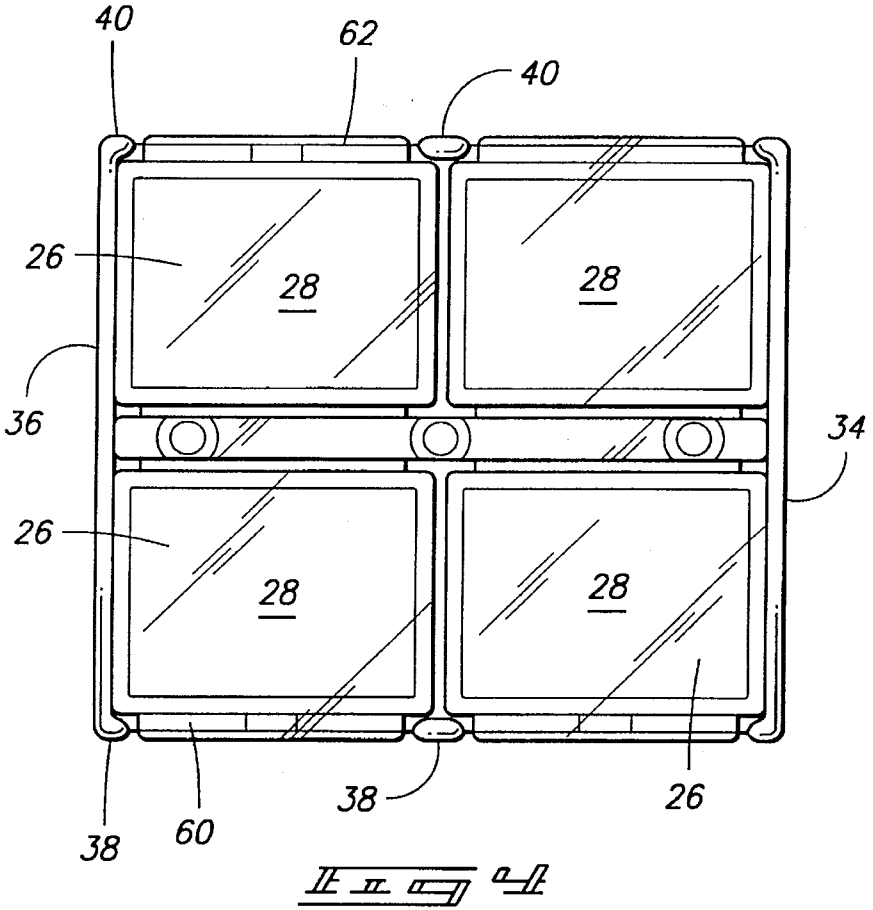
FIG. 7 is a top view of an alternative dispenser.
Figure 7:
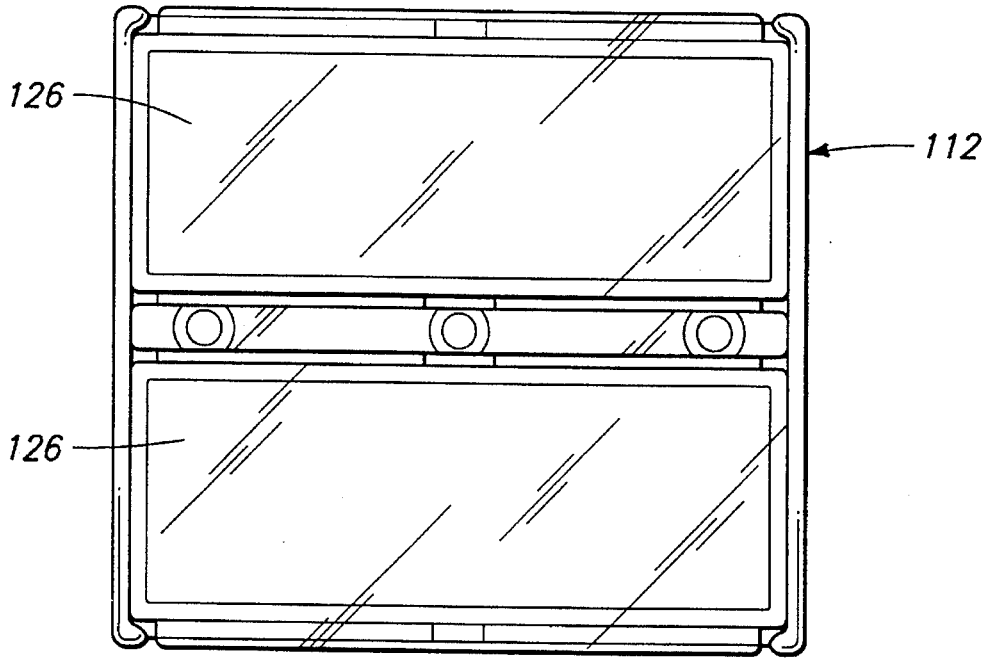
Figure 8:
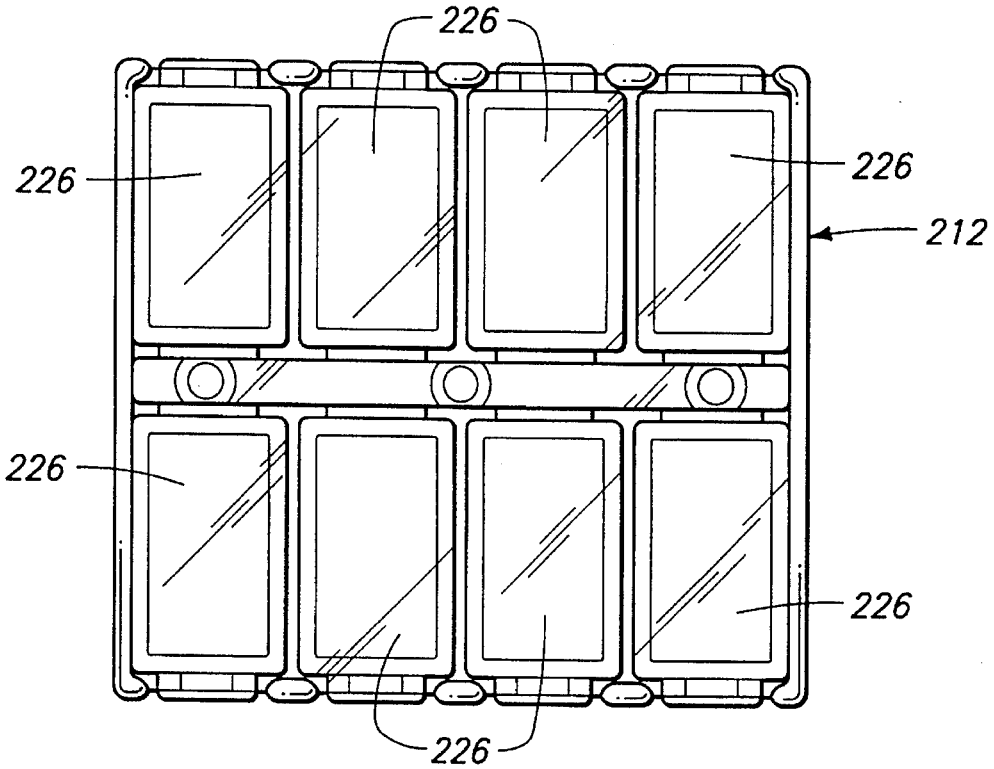
FIG. 8 is a top view of a second alternative dispenser.

The dispensers can have any number of compartments. For example, FIG. 7 shows and alternative dispenser 112, having the same overall dimensions as the dispenser 12, but having only two compartments 126. Similarly, FIG. 8 shows an alternative dispenser 212, having the same overall dimensions as the dispenser 12, but having eight compartments 226.

In the illustrated embodiment, the assembly 10 has exactly seven dispensers, each having a unique day of the week displayed thereon. The tray 42 has the general shape of an open top rectangular box, and the dispensers each have complementary rectangular shapes for close sliding receipt of the dispensers in the tray 42.

Figure 10:
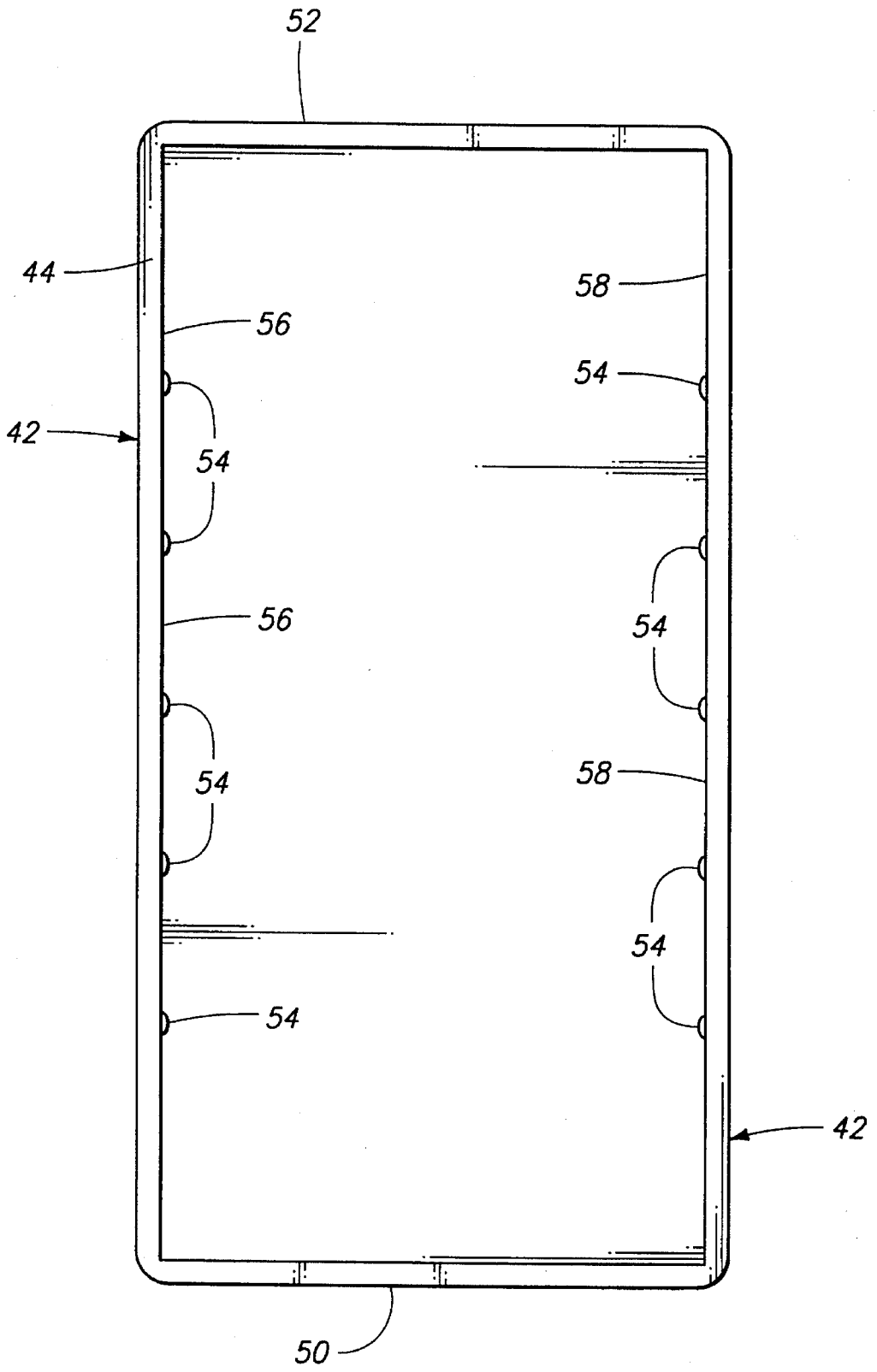
FIG. 10 is a top view of an alternative tray.
Figure 11:
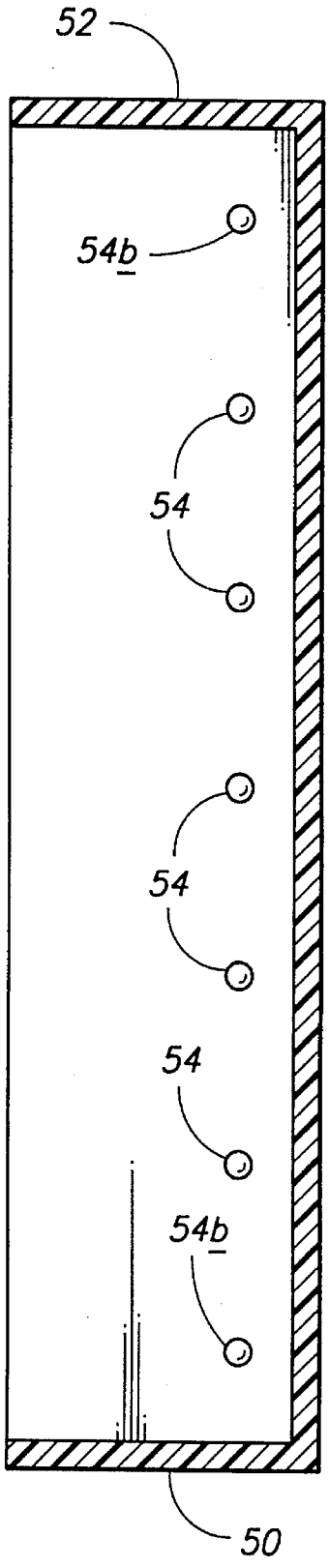
FIG. 11 is a sectional view taken along line 11—11 of FIG. 9.
Figure 12:
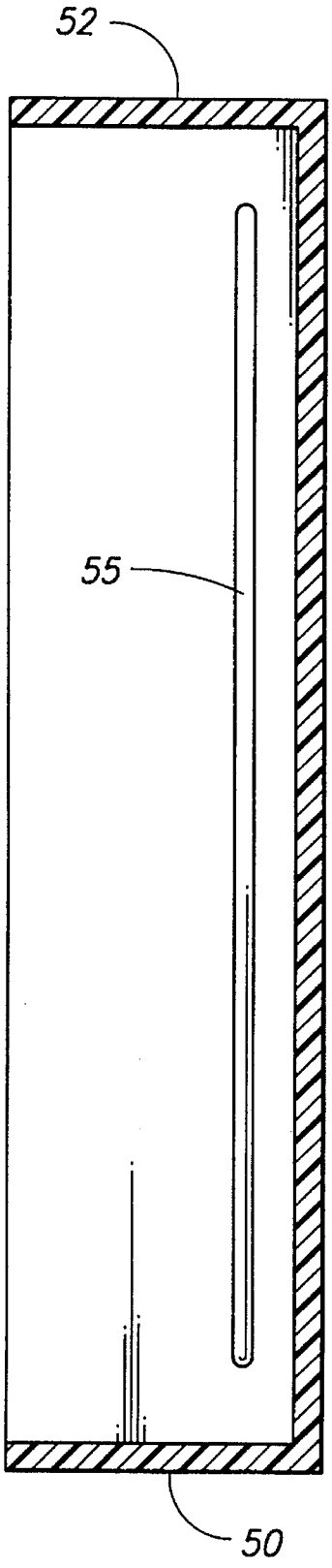
FIG. 12 is a sectional view of a second alternative tray.

The tray 42 has opposite ends 50 and 52 along the length of the tray. The dispensers and the tray have interengaging opposed surfaces which both in combination permit sliding of the dispensers within the tray and along the length of the tray. The interengaging surfaces restrain transverse removal of the dispensers from the tray except for at least one dispenser located at one of the ends 50 and 52 of the tray 42. Thus, a user can discern based on the restraint whether the user is attempting to remove the one endmost dispenser (e.g., dispenser 24 in FIG. 1) or another dispenser from the tray. In the illustrated embodiment, the dispenser at the other end of the tray (e.g., dispenser 12 in FIG. 1) is also free from the restraint of the interengaging surfaces. In the illustrated embodiment, the interengaging surfaces comprise bumps 54 (FIG. 9) or ribs 55 (FIG. 12) on opposite inner sidewalls 56 and 58 of the tray 42, and recesses 62 in edges 38 and 40 of the dispensers. The bumps or protrusions 54 are spaced apart along the length of the tray 42, but are either reduced in size (bumps **54*b* in FIG. 9) or omitted (FIG. 10) at the ends 50 and 52 of the tray 42 to permit easy removal of the endmost dispensers from the tray 42. Preferably, the recesses 60 and 62 in the dispensers extend from the top 30 to the bottom 32 of the dispensers (i.e., in the length direction L shown in FIG. 9) so as to permit sliding of the dispensers in the tray in the length direction L. While various dimensions can be used, in the illustrated embodiment the projections 54 extend approximately 1/16 inch out from the sidewalls 56 and 58 of the tray 42. The entire assembly weighs 166 grams. Each dispenser weighs 17½ grams. The tray has outer dimensions of 4.68 inches (length)×2.45 inches (width)×1.1 (height). Each dispenser has an overall length of 2.5 inches (between edges 34 and 36) a height of 0.63 inches, and an overall width (between edges 38 and 40) of 2.28 inches. These dimensions are given by way of example only. The dispensers and the tray 42** are preferably made of plastic.

In the illustrated embodiment, the restraint caused by the interengaging surfaces can selectively be overcome so that the dispensers subject to the restraint (the intermediate dispensers 14, 16, 18, 20, and 22 in FIG. 1) can be removed from the tray 42. However, the interengaging surfaces restraint is sufficiently high such that if a user lifts a dispenser subject to the restraint without also holding down the tray 42, the entire assembly will be lifted, and the lifted dispenser will not be removed from the tray 42. In an alternative embodiment (not shown), the restraint cannot be overcome, and the dispensers can only be removed or inserted at an end 50 or 52 of the tray.

Each dispenser optionally contains indicia for indicating if a compartment has been opened, in view of regulations against reusing such dispensers. This indicia can take the form of means for preventing tight reclosing of the compartments after they are opened, a pin (not shown) which breaks when the compartment is opened, or other visual indicia that the compartment has been opened.

In operation, each dispenser 12, 14, 16, 18, 20, 22, and 24 is loaded with medication to be consumed on the day 46 of the week marked on the dispenser. More particularly, each compartment is loaded with medication to be consumed at the time 48 of day marked adjacent the compartment being loaded.

Then, the dispensers are inserted into the tray 42 such that the day 46 of the week marked on each dispenser is visible, such that the dispensers are ordered in the tray 42 in sequence based on the day of the week each dispenser is to be used, with the first day's dispenser at the front end 52 of the tray. For example, if treatment is to start Wednesday, the dispenser 16 marked "WEDNESDAY" will be placed at the front end of the tray, the dispenser marked "THURSDAY" will be placed behind the Wednesday dispenser, the dispenser marked "FRIDAY" will be placed behind the Thursday dispenser, and so on in order of days of the week. If treatment is to start on Saturday, dispenser 24 marked "SATURDAY" will be placed at the front end of the tray, with subsequent day's dispensers behind it (FIG. 13).

The dispensers are used by removing the dispenser at the front end of the tray 42 (as shown in FIG. 13 by arrows 64) and consuming or administering medication therein during the day marked on that dispenser, to empty that dispenser, and, when all medication for that day is consumed, sliding the remaining dispensers in the tray toward the front end 50 of the tray 42 (as shown in FIG. 13 by arrow 66) and replacing the empty dispenser in the tray at the back end 52 of the tray 42 as shown by arrows 68 in FIG. 14.

In the preferred embodiment, the empty dispenser is replaced upside down at the back end of the tray, with the blank edge 36 facing upwardly. This provides a visual indication as to how many days medication has been used up, and how many days medication is left. Medication administration is simplified in that the user always knows that today's medicine is in the dispenser at the end 50 of the tray. If the user is careless in pulling a dispenser from the tray, the interengaging surfaces will provide a non-visual indication that the user is pulling the wrong dispenser. The color coding will also make clear which dispenser is to be used during a particular day. A weeks worth of medication can be planned and arranged for a patient.

It will be apparent to one of ordinary skill in the art that the assembly could be used for purposes other than dispensation of medicine. For example, the assembly can be used for dispensing vitamins or food supplements. Further, the assembly can be used to store any item that is to be retrieved in a predetermined order or at predetermined intervals.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. An assembly for dispensing objects of interest, comprising:

a rectangular shaped tray having sidewalls, a bottom surface, and opposite ends, and wherein the sidewalls and bottom surface define a cavity having given length, width and depth dimensions, and wherein the cavity has a longitudinal line of reference;

a restraining portion borne by the sidewall of the tray and disposed between the opposite ends of the tray; and a plurality of nestable dispensing containers matingly received in the cavity of the tray, each dispensing container having top and bottom surfaces, and a substantially continuous sidewall, and wherein the dispensing containers each have a given length dimension which is greater than the depth dimension of the cavity, and a width dimension which is less than the width dimension of the cavity, and wherein the restraining portion frictionally engages each of the dispensing containers disposed intermediate the opposite ends of the tray and guides the individual dispensing containers along a given path of travel which lies in the same plane as the longitudinal line of reference, and wherein individual dispensing containers moved to the opposite ends of the tray are disengaged from the restraining portion and are substantially freely moveable along a course of travel which is substantially transverse to the longitudinal line of reference, and wherein dispensing containers disposed intermediate the opposite ends of the tray are moveable along a course of travel transverse to the longitudinal line of reference following the application of force of a given magnitude which is effective to overcome the frictional force provided by the restraining portion, the force being of a magnitude which does not substantially deform the tray, and wherein containers removed from the tray may be inserted back into the cavity in an inverted position.

2. An assembly as claimed in claim 1, wherein the restraining portion provides frictional resistance of a magnitude whereby failure to physically restrain the tray while attempting to remove a single nestable dispensing container disposed intermediate the opposite ends of the tray will not result in the removal of the dispensing container from the cavity.

3. An assembly as claimed in claim 1, wherein the individual nestable containers are provided with visibly discernible indicia which is placed in predetermined locations on the individual nestable containers.

4. An assembly as claimed in claim 3, wherein the visibly discernible indicia includes color coding and alpha-numeric designations, and wherein the color coding and alpha-numeric designations are located on predetermined areas of the individual nestable containers such that selective indicia may not be visibly discerned once the individual nestable containers are received in the cavity of the tray.

5. An assembly as claimed in claim 4, wherein the tray houses seven nestable containers.

6. An assembly for dispensing objects of interest, comprising:

a rectangular shaped tray having sidewalls, a bottom surface, and opposite ends, and wherein the sidewalls and bottom surface define a cavity having given length, width and depth dimensions, and wherein the cavity has a longitudinal line of reference;

a restraining portion borne by the sidewall of the tray and disposed between the opposite ends of the tray; and a plurality of nestable dispensing containers matingly received in the cavity of the tray, each dispensing container having top and bottom surfaces, and a substantially continuous sidewall, and wherein the dispensing containers each have a given length dimension which is greater than the depth dimension of the cavity, and a width dimension which is less than the width dimension of the cavity, and wherein the restraining portion frictionally engages each of the dispensing containers disposed intermediate the opposite ends of the tray and guides the individual dispensing containers along a given path of travel which lies in the same plane as the longitudinal line of reference, and wherein the restraining portion provides frictional resistance of a magnitude whereby failure to physically restrain the tray while attempting to remove a single nestable dispensing container disposed intermediate the opposite ends of the tray will not result in the removal of the dispensing container from the cavity, and wherein individual dispensing containers moved to the opposite ends of the tray are disengaged from the restraining portion and are substantially freely moveable along a course of travel which is substantially transverse to the longitudinal line of reference, and wherein dispensing containers disposed intermediate the opposite ends of the tray are moveable along a course of travel transverse to the longitudinal line of reference following the application of force of a given magnitude which is effective to overcome the frictional force provided by the restraining portion, the force being of a magnitude which does not substantially deform the tray, and wherein containers removed from the tray may be inserted back into the cavity in an inverted position.

* * * * *